United States Patent [19]

Bisak

[11] Patent Number: 5,021,779

[45] Date of Patent: Jun. 4, 1991

[54] SECURITY DEVICE

[75] Inventor: Michael Bisak, 32 Sullivan Street, Springvale, Victoria 3171, Australia

[73] Assignees: Michael Bisak; Jeffrey Dunn; Walter Cole, all of Victoria, Australia; part interest to each

[21] Appl. No.: 344,555

[22] PCT Filed: Aug. 14, 1986

[86] PCT No.: PCT/AU86/00232

§ 371 Date: Jun. 3, 1987

§ 102(e) Date: Jun. 3, 1987

[87] PCT Pub. No.: WO87/01229

PCT Pub. Date: Feb. 26, 1987

Related U.S. Application Data

[63] Continuation of Ser. No. 64,258, Jun. 3, 1987, abandoned.

[30] Foreign Application Priority Data

Aug. 14, 1985 [AU] Australia ..... PH01976

[51] Int. Cl.[5] ..... G08C 19/00

[52] U.S. Cl. ..... 340/825.69; 340/310 R; 340/538; 340/568; 340/825.72

[58] Field of Search ..... 340/538, 568, 571, 572, 340/825.06–825.34, 825.36, 310 R, 310 A, 524, 539, 505, 506, 518, 825.69, 825.72

[56] References Cited

U.S. PATENT DOCUMENTS

| | | | |
|---|---|---|---|
| 3,337,992 | 8/1967 | Tolson | 340/533 X |
| 3,411,150 | 11/1968 | Schulein | 340/568 X |
| 3,594,584 | 7/1971 | Woods . | |
| 3,633,199 | 6/1972 | Curry et al. . | |
| 3,644,912 | 2/1972 | Allen . | |
| 3,766,540 | 10/1973 | Schopfer et al. . | |
| 4,156,866 | 5/1979 | Miller | 340/825.52 X |
| 4,173,754 | 11/1979 | Feiker | 340/825.52 X |
| 4,418,333 | 11/1983 | Schwarzbach et al. | 340/825.07 X |
| 4,446,458 | 5/1984 | Cook | 340/538 X |
| 4,511,888 | 4/1985 | Bernhardt | 340/568 X |
| 4,593,273 | 6/1986 | Narcisse | 340/571 |

FOREIGN PATENT DOCUMENTS

| | | |
|---|---|---|
| 57596 | 6/1975 | Australia . |
| 24559/84 | 9/1984 | Australia . |
| 2137391 | 10/1984 | United Kingdom . |
| 2154037 | 8/1985 | United Kingdom . |

OTHER PUBLICATIONS

Britt Rorabaugh, "Data Communications", *Tab Books Inc.*, Blue Ridge Summit, Pa., 1985, p. 226.

D. R. Doll, "Data Communications" John Wiley & Sons, N.Y., 1978, pp. 65, 68, 69.

*Primary Examiner*—Ulysses Weldon

*Attorney, Agent, or Firm*—Dennison, Meserole, Pollack & Scheiner

[57] ABSTRACT

A security device for an electrical appliance which derives input from an electrically connected external source, the device comprising a receiver-decoder which is adapted and arranged to allow the appliance to operate in its normal mode when the receiver-decoder receives a predetermined code carried via the external source and not to allow the appliance to operate in its normal mode when the predetermined code is not received.

12 Claims, 4 Drawing Sheets

SECURITY DEVICE

This is a continuation of copending application Ser. No. 07/064,258 filed on June 3, 1987 now abandoned.

BACKGROUND OF THE INVENTION

1. Field of the Invention

This invention relates to a security device and a method for securing electrically powered appliances.

Electrically powered appliances such as television sets, video recorders and personal computers are widely used. However, they are prone to theft.

Security devices have been proposed. One such device including an alarm is fitted to an electrical appliance and adapted so that the alarm will remain off provided the appliance is plugged in and switched on to its power source. Once the power is switched off or disconnected the device is adapted so that the alarm is actuated by physical movement of the appliance. This security device suffers from the disadvantage that a stolen appliance is fully operable in a new location. Another security device is disclosed in GB No. 2137391 in which the device consists of a radio transmitter and receiver with an alarm where both the receiver and alarm are attached to an article. If the article is removed beyond a predetermined distance from the transmitter, the alarm is actuated. Within this device, it is difficult to have a precise effective transmission range.

It is an object of this invention to provide an improved security device which either lessens the likelihood of theft of electrical appliances or improves the chance of recovery of such appliances when stolen.

2. Summary of the Invention

Accordingly, in one form this invention provides a security device for an electrical appliance deriving input from an electrically connected external source, the device comprising a receiver-decoder which is adapted and arranged to allow the appliance to operate in its normal mode when the receiver-decoder receives a predetermined code carried via the external source and not to allow the appliance to operate in its normal mode when the predetermined code is not received.

In another form the invention provides a security device for an electrical appliance deriving input from an electrically connected external source, the device comprising an encoder-transmitter for encoding the external source with a predetermined code.

In a further form the invention provides a security device for an electrical appliance deriving input from an electrically connected external source, the device comprising in combination an encoder-transmitter for encoding the external source with a predetermined code and a receiver-decoder which is adapted and arranged to allow the appliance to operate in its normal mode when the receiver decoder receives the predetermined code and not to allow the appliance to operate in its normal mode when the predetermined code is not received.

The invention further provides a method for securing an electrically powered appliance deriving input from an electrically connected external source, the method comprising the steps of encoding the external source with a predetermined code and adapting the appliance so as to operate in its normal mode only when the predetermined code is received from the external source.

The receiver-decoder is preferably physically fitted within or is an integral part of the appliance.

Preferably the electrically powered appliance further comprises an alarm means within the appliance which alarm means is actuated when the predetermined code is not received by the appliance.

In a preferred embodiment the electrically connected external source is an electricity power supply.

In one preferred form the encoder-transmitter is arranged to frequency modulate a carrier signal with a binary digital code and this signal is carried by the electrical wiring in for example a domestic dwelling. The transmitter-encoder is preferably connected to a dwelling's electrical wiring at a place remote from the appliance to be secured, and preferably is concealed in a safe location.

In this specification the phrase "external source" means the source is physically separate from the appliance. Examples, of external sources would be a domestic dwelling's fixed electricity supply, either alternating or direct current; or an antenna for a television or radio receiver. The "external source" is fixed in the sense that it is not readily physically removed. The "input" may be for example electrical power to drive the appliance or a signal received by an aerial for subsequent reception and amplification. The expression "electrically connected" means physically connected through conducting means and not through the air medium.

BRIEF DESCRIPTION OF THE DRAWINGS

Particular examples according to the invention will now be described by references to the drawings in which.

DESCRIPTION OF THE PREFERRED EMBODIMENTS

Figure 1:
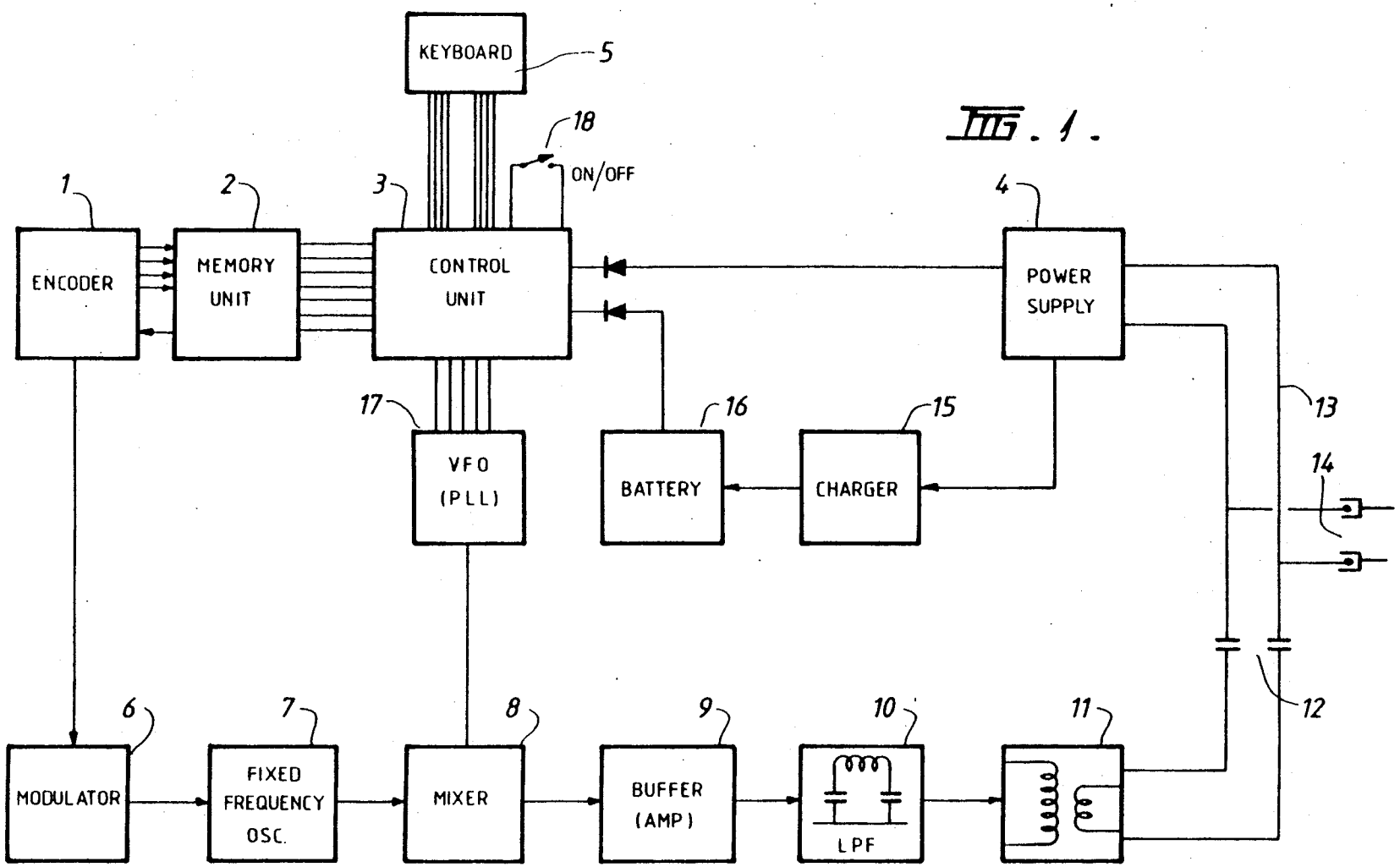
FIG. 1 is a schematic block diagram of a transmitter encoder.

Referring to FIG. 1, the transmitter-encoder operates by the following scheme.

The main purpose of the control unit 3 is to enable communication between the transmitter-encoder and the user, through a keyboard 5 and an on-off switch 18. By entering the desired codes into the control unit 3 through the keyboard 5 the user can set up a predetermined code that the transmitter-encoder will transmit, and select what channel it will be sent on. The control unit 3 is not essential for this invention, but renders the finished product more flexible and easier to use. The predetermined code for the encoder 1, and a code for channel selection can be set up by using ordinary DIL switches or their equivalents. However, if for any reason the codes ever have to be changed, it is easier to enter in information on the keyboard 5 than opening up the unit for modifications on the DIL switches.

The control unit 3 feeds the memory unit 2 with the predetermined code where it is stored. The encoder 1 scans the memory 2 for the predetermined code, which is then sent to the encoder 1 in serial form. The encoder 1 encodes this information into a suitable signal and in turn sends it to a modulator 6, which in turn frequency (or phase) modulates the fixed frequency oscillator 7. The modulated signal is then fed to a mixer 8 together with another signal which comes from the VFO 17. The signal coming from the VFO 17 is a stable frequency signal, but its frequency depends on which channel it is set for. These two signals are then mixed in the mixer 8, so as to generate the frequency (or phase) modulated signal that is required. This signal is then sent to a buffer 9 (or amplifier) to make the signal large enough for transmission. The LPF 10 (low pass filter) removes any harmonics that may still be on the wanted signal, thereby reducing the risk of electro magnetic interference to other appliances. The signal is then fed into the line through isolating capacitors 12 and an isolating transformer 11.

The two capacitors 12 perform at least two functions. One function is to allow the wanted signals through without any attenuation and matching the signals to the line (impediance matching), and the other function is to stop any power from the line being able to reach the output stage of the encoder-transmitter. Although one would usually suffice, two are included for safety reasons.

The isolating transformer 11 is also used to prevent power from reaching the transmitter output stage and it also matches the transmitters impediance to the power line. (The power line may be either high or low voltage AC or DC).

The power for the transmitter is delivered from the line. The power supply 4 enables the voltage from the line to be matched to that which the transmitter requires, and to rectify it to DC if AC lines are being used. Power from the power supply 4 goes to the battery charger 15 and the control unit 3, which then transfers the power to the other circuits as needed. The battery charger 15 maintains a rechargeable battery 16 in a charged state, which in case of power failure would supply power to the whole unit so as to keep it working. As long as there is power available from the line, the transmitter uses that power to operate and to keep the back up battery fully charged.

The on-off switch 18 is to turn power off to the encoder-transmitter to preserve battery power in case the transmitter is being shifted or when testing the unit.

The encoder-transmitter may have many physical forms. For example it can be built into the container of a plugpack, so the only installation required would be to plug one into any power point in the building, to protect any appliance in it that we desire. It can also be built into the back of power points, light switches, into wall cavities, into the main console of a house alarm, or other convenient item.

Figure 2:
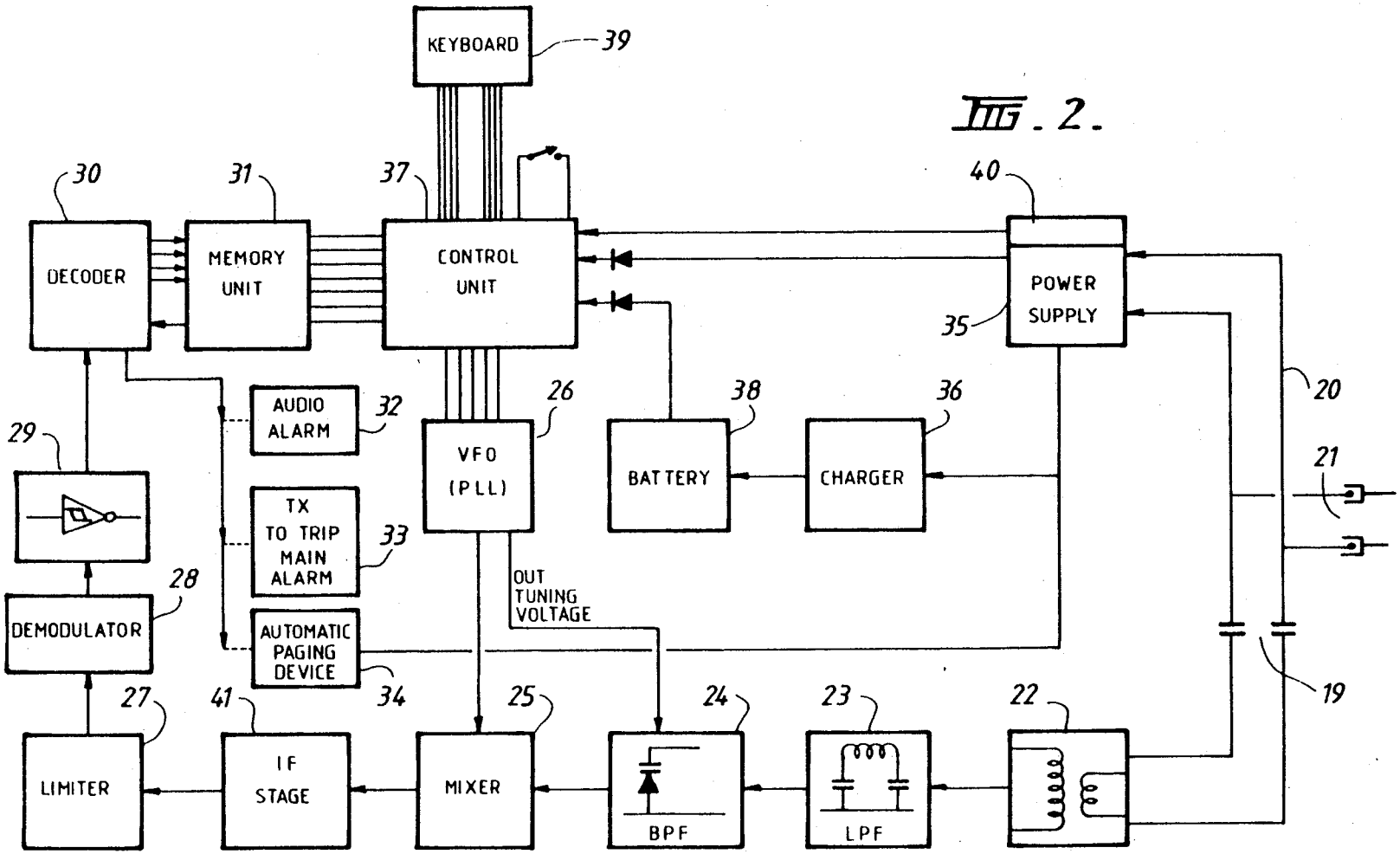
FIG. 2 is a schematic block diagram of a receiver decoder.

Referring to FIG. 2, the receiver-decoder operates as follows: The modulated signal (e.g. frequency or phase etc) from the transmitter-encoder enters the appliance through the appliance power cord. Since isolating capacitors 19 have low reactance at the frequency of the signal, they pass the signals through while stopping the power from reaching a transformer 22. What minor amount may get through to the transformer 22 (rf) primary, will be still more attenuated by the transformer 22. Therefore, the separation of the wanted signal from the power line is achieved. From there the signal is fed into a low pass filter 23, which attenuates all signals which are higher than signal desired to be received. Without this filter, there may be some high level signals present at the next stages causing overloading of the receiver-decoder. The unwanted signals may be, for example, medium wave broadcast signals.

The signal is then fed to a bandpass filter 24. This filter 24 has two functions. One is to preselect the desired signal so as the mixer 25 which is the next stage does not become overfed with too many undesired signals. The second use of the filter is that provided it is tuned correctly, it removes much of the undesired noise from the desired signal. It is well known that power lines are very noisy, but by having this filter tuned to the correct frequency, it substantially eliminates this noise. The filter is tuned to the correct frequency by the tuning voltage, which is derived from the VFO 26. Therefore depending on which channel the receiver is tuned to, the voltage will also tune the bandpass filter to the same frequency.

The signal is then fed together with another signal from the VFO 26 to the mixer 25. These two signals are then mixed in the mixer 25 to produce an intermediate frequency. This means that whatever channel is desired to be received, the signals on that channel will be converted to the intermediate frequency. The remainder of the receiver-decoder functions as any normal FM receiver would. The intermediate signal is filtered 41 so as only the bandwidth of one channel spacing may get through. Then the signal is sent to the limiter 27 which amplifies the signal so as to remove any AM component. As noise is basically an amplitude modulated signal, this is particularly suitable. The signal from the limiter 27 is fed to the demodulator 28. After demodulation, it is fed to a schmitt trigger 29 so as to get the original square shape back in the transmitted signal, as decoders work best with high rise and fall signals. On the schmitt triggers 29 input there is a low pass filter as to remove any glitches from the signal, that may have got through to this stage.

The received signal is then fed to the decoder 30 where it is compared with the code kept in the memory 31. If the signal received matches up with the one that is kept in the memory 31 the output of the decoder 30 is maintained at a low level, and the unit behaves normally. For example, the appliance into which this alarm is fitted behaves like any other appliance. However, should the incorrect code be received, or no signal received at all, a number of things can or will happen, depending on what the unit is designed to do.

In one mode, upon no signal being received due to unplugging the appliance, unplugging the transmitter, or if the wrong code is received, the decoders output will go high thereby sounding an audio alarm 32 inside the appliance. Also, if the appliance is plugged in at a place remote from the transmitter (assume appliance has been stolen) it will not operate without the correct code being received.

In another mode, upon removing appliance from wall socket or from its power source, the output of the decoder 30 would energize a device 33 which would trigger an external alarm. For example, it may trigger the external alarm through a radio link or some other method. A small transmitter inside the appliance (not to be confused with the transmitter-encoder) may be used and an external receiver which would pick up the signal from the transmitter, upon which it would set off an external alarm (silent or other) for example phone dialler.

In another mode if the appliance is stolen, when taken away and plugged in it behaves to the user as being normal. However, the appliance would have a hidden transmitter 34 inside it (not to be confused with the other two transmitters mentioned so far) which would continually send out a radio signal. By tracking that signal down through direction finding techniques, the stolen appliance would be recovered. The transmitter 34 inside the appliance would be set off by not receiving the correct signal, or no signal at all and would send or transmit a code that is unique to the appliance being stolen. This transmitter 34 may be powered from the internal back up battery, or only when the appliance is plugged into a suitable power source. In this invention transmission from this transmitter is regarded as abnormal operation of the appliance.

Power for the receiver-decoder is then taken from the line. The power supply 35 is directly connected to the signal carrying line (power line). The power supply 35 matches the voltage from the line to what the receiver-decoder needs, and rectifies it to DC if AC lines are being used. The power from the power supply 35 goes to a battery charger 36 and the control unit 37, which passes on the power to the other sections as needed. The battery charger 36 keeps the rechargeable battery 38 charged, which in case of power failure would supply power to the whole unit, so as to keep the whole system working continually as needed. Provided there is power available on the line, the receiver-decoder uses that power to operate and to keep the backup battery fully charged.

The control unit 37 is basically the same as the one for the transmitter-encoder. For example its main purpose is to provide communication between the receiver-decoder and the user, through the keyboard 39. The main difference is that the receiver-decoder cannot be turned off simply just by an on-off switch. If it could, it would not be secure at all. In this example the only way to turn the receiver-decoder off is by punching in the correct code on the keyboard 39, in which case the receiver-decoder will be deactivated and the appliance can be pulled out of the power socket and taken anywhere. However, when it is plugged back in the wall, a pulse is generated in the power supply (pulse generator 40) and that pulse turns the receiver-decoder on. Effectively the unit does not have to be turned on but does this itself automatically as soon as it is plugged in. This makes it a foolproof unit.

The code within the receiver-decoder memory unit 31 is required to be the same as the one in the transmitter-decoder. If the two do not match, the alarm 32 will be activated. If the need arises to change the code in the memory 31, it can be changed through the keyboard 39. Naturally, it is inadequate if anyone can punch in a new code as a stolen appliance could be reused by someone else. The code can only be changed if one knows what the code in it already is. For example, a user would have to punch in the code that is in it now (which only the user should know) followed by the one the user would like it changed to. This means that if somebody should steal the appliance they cannot reprogram it for their use because they do not know what the existing code in it is. However, provided it operates in the desired manner the receiver-decoder will work with the new code in it, while forgetting the old one.

Figure 3:
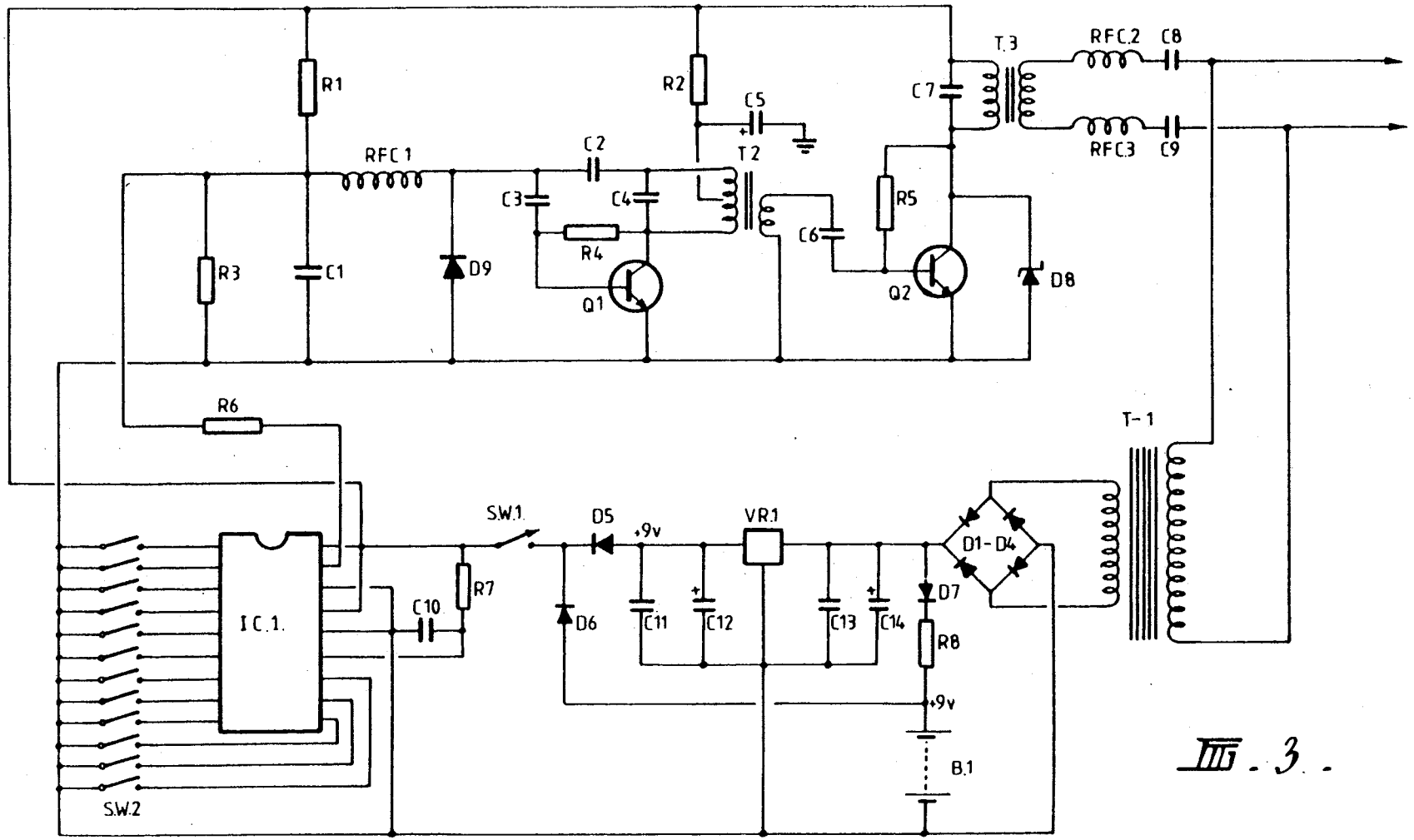
FIG. 3 is a circuit diagram of an alternative transmitter-encoder.
Figure 4:
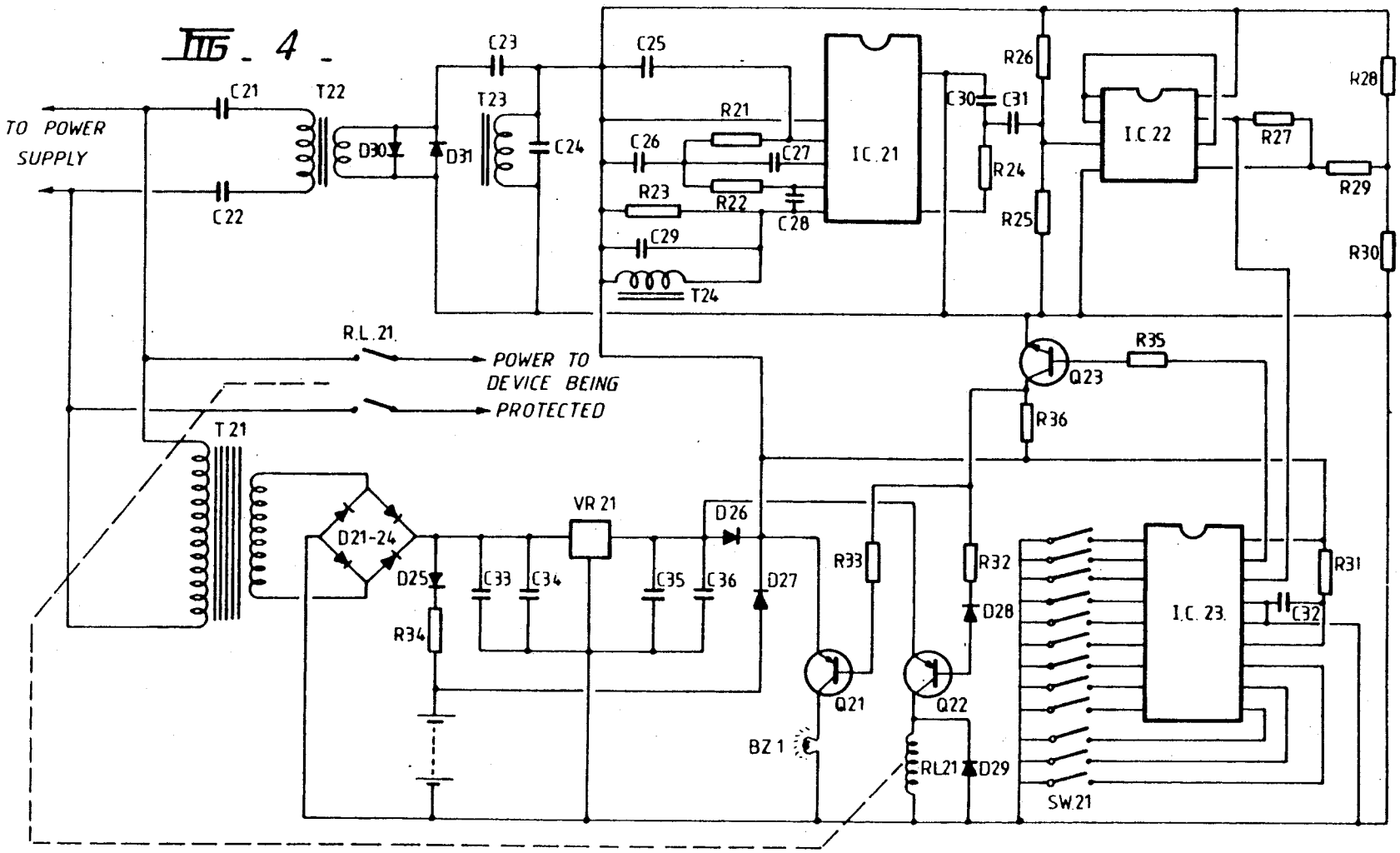
FIG. 4 is a circuit diagram of an alternative receiver-decoder.

FIGS. 3 and 4 show the circuit diagram of a simplied example. FIG. 3 shows the encoder-transmitter, while FIG. 4 shows the receiver-decoder.

In FIG. 3, R1=100K Ohm; R2=2.2K Ohm; R3=33K Ohm; R4=390K Ohm; R5=33K Ohm; R6=150K Ohm; R7=100K Ohm; R8=1.8K Ohm;

C1=0.0022 F; C2=100 pF; C3=100 pF, C4=0.001 F; C5=100 uF; C6=0.01 F; C7=0.0047 F; C8=0.0047 F (240 VAC);

C9=0.0047 F (240 VAC); C10=0.001 F; C11=0.047 F; C12=220 uF; C13=0.047 F; C14=470 uF;

RFC1=10 mH; RFC2=47 uH; RFC3=47 uH;

T1=Power transformer with 12 VAC secondary at 200 mA; T2=Oscillator coil; T3=Output transformer;

IC.1=MM53200N;

D1=EM4002; D2=EM4002; D3=EM4002; D4=EM4002; D5=EM4002; D6=EM4002; D7=EM4002; D8=12 Volt zener diode;

D9=IS553;

Q1=MPS9631; Q2=MPS9632;

VR1=9 Volt voltage regulator (7809)

SW1=On-Off Switch; SW2=1×12 DIP switch

In FIG. 4, R21=2K2 ohm; R22=47K ohm; R23=47K ohm; R24=10K ohm; R25=220K ohm; R26=220K ohm; R27=470K ohm; R28=10K ohm; R29=10K ohm; R30=8K6 ohm; R31=100K ohm; R32=4K7 ohm; R33=4K7 ohm; R34=1K8 ohm; R35=22K ohm; R36=22K ohm;

C21=0.01 F (250 VAC); C22=0.01 (250 VAC); C23=12 pF; C24=0.0015 F; C25=12 pF; C26=0.01 F; C27=0.01 F; C28=10 pF; C29=0.0015 F; C30=0.02 F; C31=100 uF; C32=0.001 F; C33=470 uF; C34=0.047 F; C35=220 uF; C36=0.047 F;

IC.21=MC3357; IC.22=LM358; IC.23=MM53200N;

D21=EM4002; D22=EM4002; D23=EM4002; D24=EM4002; D25=EM4002; D26=EM4002; D27=EM4002; D28=IN914; D29=IN914; D30, D31=IN914;

Q21=BC327; Q22=BC327; Q23=BC107;

VR.21=9 Volt voltage regulator (7809)

SW.21=1×12 DIP switch

RL1=Relay (2 pole) Coil 9 Volts DC Contacts rated at 240 Vac. N.C.

BZ21=9 Volt buzzer, siren or other audio indicator;

T21=Power transformer with 12 Vac secondary at 200 mA; T22=Input isolating transformer; T23=Tunable coil for 260 KHz;

T24=Tunable coil for 260 KHz.

It operates on a single channel, so once it is set up for a particular frequency it is fixed on that frequency. The circuit uses frequency modulation to modulate the signal. FIG. 3 is basically a FM transmitter which is modulated by the desired code, and its output is fed into the power lead of the appliance which is being secured. The circuit design is specifically designed to work on AC lines, in this instance at 240 V.

Referring to FIG. 3, the AC power enters the device and the transformer T1 reduces the voltage to a more suitable level, 12 Volts AC. The power is then fed into a bridge rectifier (D1–D4). The voltage is then smoothed out by C13 and C14, before being applied to the voltage regulator, (VR1). The bridge rectifier (D1–D4) also trickle charges the ni-cad back up battery (B1) through the limiting resistor R8. The value of that resistor is chosen so as not to damage the battery, by overcharging it.

The voltage regulator fixes the voltage from the power supply at 9 volts, and this sources the remainder of the circuit. In case of power failure, D5 and D6 work in such a manner as to switch the battery B1 into the circuit. The on-off switch is included to turn the unit off in case it is not needed, or the unit is being shifted so as to prevent a flat battery. SW2 is a set of switches which set up the required code for the receiver. IC1 scans through these switches continuously and its output (pin 17) therefore carries the code. The output from IC1 is fed into the BJT (Q1) oscillator, and its frequency modulates the signal. The heart of the modulator is D9 which is basically a voltage dependent capacitor. The signal is then fed by T2 into the next stage which is Q2 and it amplifies the signal. The signal is then fed into T3 and out into the line through RFC2, RFC3, C8 and C9. C8 and C9 have to be rated at a high voltage for safety reasons. If they should break down for any reason, T3 will short circuit across the line and it may fail. Hence it is essential to use suitable capacitors for C8 and C9.

Referring to FIG. 4 in the receiver-decoder the power supply, battery charger, and the automatic switch for backup power is identical to the transmitter-encoder. Also the same IC (IC23) is used for decoding the coded signals as was used in the transmitter-encoder.

The signal enters the appliance through the power lead and is fed through C21 and C22 (rated at 250 VAC) into T22. The signal is then filtered by the bandpass filter T23 and C24 and fed into IC21 through the bypass capacitor C25. IC21 is basically an FM receiver. The capacitors C26, C27, C28, C29, resistors R21, R22, R23, assist the IC (IC21) to amplify and demodulate the received signal through its input pin (pin 5). The output emerges at pin 9 and then it is fed through a low pass filter R24 and C30 to regain some of its original shape. IC22 has two functions. Its first stage acts as a buffer, so as not to load the preceding sections, and its second stage is a schmitt trigger which squares up the received signal. It is then fed into the decoder. As long as both the transmitter and the decoder are set up with the same code (SW2 and SW21), the output from the decoder is low. Q23 acts as an inverter so it keeps both Q21 and Q22 off. The relay has normally closed contacts so the appliance works normally. Should the receiver-decoder for any reasons receive the wrong code, or no code at all, the output from IC23 will, go high, turning Q23 on, and then turning both Q21 and Q22 on, setting off the alarm (B21) and as long as the appliance is plugged in, RL21 will pull out, and the appliance becomes useless. However, if the appliance is pulled out of the power socket, the relay will drop back in so as to preserve battery power, but as soon as it is plugged back in again, it will drop out. It is possible to make the appliance not operable by other means as well. For example, although the relay RL21 disconnects the power to the appliance, in case there is no correct code being received, there are other ways of achieving the same result, but this is dependent on the appliance it is used in.

The transmitter and receiver shown in FIGS. 3 and 4 works on 260 Khz, as it tunes up there at switch on, but it is possible to tune them onto other frequencies.

The frequency spectrum used by the transmitter and the receiver in the above example is preferred but the invention can work in other frequency spectra.

The preferred example is described above with reference to an AC power system but the invention is not so limited and this security device can be used on a distribution system as well. It can also be used where AC or DC portable power is used either originating from a battery or some other power generating device, or any device or appliance that obtains its power source by external means. If the appliance is fed by power internal to the device, the same security device can be incorporated in the appliance, however, the coded signal would have to enter the appliance by other external means. For example, to protect a video recorder or TV set, the frequency modulated signal can enter the video by the actual aerial socket. The code then becomes separated inside the appliance and the signal is processed in the same way as explained in the detailed example.

The piezo alarm for indicating the abnormal condition of the appliance is by way of example only and any other means of causing abnormal operation may be implemented. For example, a consequence of the predetermined code not being received could be the appliance does not operate. Alternatively, if no code is received or if the code received is not the predetermined code, the decoders output can be arranged so that its output becomes high. In this situation however, the high output from the decoder can actuate a transmitter which has a unique number encoded onto its carrier and this newly generated signal is transmitted by the appliance. In appliances where there is an external aerial condition, this signal can be fed through the aerial socket to the aerial that the appliance uses in normal operation, and this aerial will transmit the signal. In other appliances, where no aerials are needed for its normal operation, for example personal computers, the appliance would need to have an aerial built into it or use existing parts of the appliance for the aerial such as a power lead.

This transmitted signal, when it is received identifies what equipment or appliance is transmitting and by tracking the signal down, the location of the appliance could be found. No other person is aware that the appliance is sending out locatable information. There could be a single frequency (or a few channels) set aside for this purpose on the VHF or UHF bands. Such operation of the appliance is regarded for this specification as abnormal even though the user is unaware of the other than apparent normal operation.

The binary digital code can have any number of practical bits, as long as the receiver-decoder has the capabilities to receive and decode the transmitter-decoder's code.

The binary coded signal also includes any other codes that are capable of being sent down a frequency modulated carrier. For example, tones of audio, sub-audio or ultrasonic tones, sub carriers in the existing carrier of any frequency or in any order may be used.

We claim:

1. A security device for electrical appliances, each said appliance deriving input from an external source electrically connected to said electrical appliance by a conductor, said security device comprising:

encoder-transmitter including input means for receiving and storing a predetermined security code;

encoding means for scanning said input means to find said stored code, and upon finding said code, receiving and encoding said code to a suitable data signal;

modulating means for receiving and mixing said data signal onto a modulated carrier for continuous transmission; and transmitting means for continuously transmitting said modulated carrier on the conductor;

at least one receiver-decoder coupled to said electrical appliance, said receiver-decoder including receiving means connected to the conductor for continuously receiving said modulated carrier;

demodulating means for reconverting said modulated carrier to the data signal by demodulating said data signal out of said modulated carrier;

decoding means for receiving said data signal and comparing said data signal to a normal mode code so as to indicate at least one of the following (a) said data signal matches said normal mode code, (b) said data signal is different than said normal mode code, or (c) said data signal is missing from said modulated carrier; and said modulating means comprises:

a fixed frequency oscillator for providing a frequency for said carrier;

a variable frequency oscillator for providing a frequency associated with the conductor; and a mixer connected to both oscillators for mixing said two frequencies and for generating said modulated carrier.

2. A security device as defined in claim 1, wherein the receiver-decoder is physically located within as an integral part of each said electrical appliance.

3. A security device as claimed in claim 1, further comprising an alarm means within each said electrical appliance, whereby the alarm means is actuated when the predetermined security code is not received by said receiver-decoder.

4. A security device as claimed in claim 1, wherein said external source is an electricity power supply, and said conductor is a power cable connecting each said electrical appliance to said electricity power supply.

5. A security device as recited in claim 1, wherein said input means comprises:

a keyboard for entering said predetermined security code;

memory means connected to said keyboard for storing said predetermined security code; and switch means connected to said security device for switching ON and OFF said security device.

6. A security device as recited in claim 1, wherein said transmitting means comprises:

buffer means connected to said mixer for amplifying said modulated carrier;

a low pass filter connected to said buffer means for removing any undesirable noise from said modulated carrier; and isolating means connected to said low pass filter and to the connector for allowing certain signals to pass through without attenuation and for matching an encoder-transmitter impedance to a conductor impedance.

7. A security device as recited in claim 6, wherein said transmitting means further comprises:

a power supply for matching a conductor voltage to an encoder-transmitter voltage; and battery means having a battery for powering said encoder-transmitter during power failure.

8. A security device as recited in claim 1, wherein said encoder-transmitter is a plugpack for connecting to a power point in a building.

9. A security device as recited in claim 1, comprising:

alarm means for receiving said indicated comparison from said decoding means and for preventing said electrical appliance from operating when either one of the following comparisons occurs: (1) said data signal is different than said normal mode code, or (2) said data signal is missing from said modulated carrier.

10. A security device as recited in claim 9, wherein said alarm means is an audio alarm which activates when said non-occurrence of said match is indicated.

11. A security device as recited in claim 9, wherein said alarm means is an automatic paging device which activates when said non-occurrence of said match is indicated.

12. A security device for electrical appliances, each said appliance deriving input from an external source electrically connected to said electrical appliance by a conductor, said security device comprising:

encoder-transmitter including input means for receiving and storing a predetermined security code;

encoding means for scanning said input means to find said stored code and, upon finding said code, receiving and encoding said code to a suitable signal;

modulating means for receiving and mixing said data signal onto a modulated carrier for continuous transmission; and transmitting means for continuously transmitting said modulated carrier on the conductor;

at least one receiver-decoder coupled to said electrical appliance, said receiver-decoder including receiving means connected to the conductor for continuously receiving said modulated carrier;

demodulating means for reconverting said modulated carrier to said data signal by demodulating said data signal out of said modulated carrier;

decoding means for receiving said data signal and comparing said data signal to a normal mode code so as to indicate at least one of the following (a) said data signal matches said normal mode code, (b) said data signal is different than said normal mode code, or (c) said data signal is missing from said modulated carrier; and said receiving means comprises:

isolating means for passing said modulated carrier while blocking power also associated with the conductor;

transformer means connected to said isolating means for isolating power conductors;

a low pass filter connected to said transformer for attenuating all signals above a predetermined frequency; and a band pass filter for removing undesired noise from said modulated carrier.

* * * * *